US006342179B1

(12) United States Patent
Poloni et al.

(10) Patent No.: US 6,342,179 B1
(45) Date of Patent: Jan. 29, 2002

(54) FURNACE FOR THE DIRECT REDUCTION OF IRON OXIDES

(75) Inventors: Alfredo Poloni, Fogliano di Redipuglia; Milorad Pavlicevic, Udine, both of (IT)

(73) Assignee: Danieli & C. Officine Meccaniche SpA, Buttrio (UD) (IT)

( * ) Notice: Subject to any disclaimer, the term of this patent is extended or adjusted under 35 U.S.C. 154(b) by 0 days.

(21) Appl. No.: 09/653,283

(22) Filed: Aug. 31, 2000

(30) Foreign Application Priority Data

Sep. 6, 1999 (IT) ..... UD99A0158

(51) Int. Cl.[7] ..... C21B 7/08

(52) U.S. Cl. ..... 266/199; 266/197

(58) Field of Search ..... 266/197, 199, 266/171, 176, 155, 156; 75/488

(56) References Cited

U.S. PATENT DOCUMENTS

| | | | | |
|---|---|---|---|---|
| 3,178,162 A | | 4/1965 | Carpenter | |
| 4,212,452 A | * | 7/1980 | Hsieh | 266/197 |
| 4,470,581 A | * | 9/1984 | Ahendt et al. | 266/155 |
| 6,200,363 B1 | * | 3/2001 | Whitten, Jr. et al. | 75/488 |
| 6,214,086 B1 | * | 4/2001 | Montague et al. | 266/195 |

* cited by examiner

*Primary Examiner*—Scott Kastler
(74) *Attorney, Agent, or Firm*—Stevens, Davis, Miller & Mosher, LLP

(57) ABSTRACT

Gravitational type furnace for the direct reduction of mineral iron comprising a median reaction zone (14) in which the reactions to reduce the mineral iron occur, means (12, 13) to feed the mineral iron to said reaction zone (14), distribution means (16, 17, 18) to introduce reducing gas into said reaction zone (14), discharge means (15) to discharge the reduced metal iron, and an intake device (20) for the reducing gas, said intake device (20) being positioned in correspondence with a chamber (21) situated above said reaction zone (14), a toroidal grid (22) being arranged in said chamber (21).

11 Claims, 3 Drawing Sheets

FURNACE FOR THE DIRECT REDUCTION OF IRON OXIDES

FIELD OF THE INVENTION

This invention concerns a furnace for the production of metal iron by means of the direct reduction of mineral iron, where the iron is present in the form of oxides The furnace is of the gravitational type and is provided with an upper container from which the mineral iron, coarse or in the form of pellets, is introduced, and a lower outlet from which the directly reduced iron (DRI) is removed. In a median reduction zone, the furnace is provided with a circumferential conduit, provided with nozzles, through which reducing gas is injected.

BACKGROUND OF THE INVENTION

The state of the art includes furnaces of the gravitational type, or shaft furnaces, for direct reduction processes comprising a central part, substantially cylindrical or in the shape of a truncated cone, an upper loading zone, a lower discharge zone, a device to inject reducing gas into the central zone, and a device to suck up the gases in the upper zone.

To achieve acceptable working conditions in the direct reduction of iron oxides, it is necessary, in the loading column, to create conditions of uniform distribution of the reducing gas, both in the peripheral zones and also in the central zones of the load volume.

In conventional direct reduction furnaces, filler with mineral iron, the current of reducing gas is not efficiently distributed among the various zones in the sections of the furnace. The peripheral zone of the load column, especially for large size furnaces, is more affected by the current of gas. In every transverse section of the furnace, therefore, there is a different reducing potential which diminishes the iron reduction process in the whole load volume. The maximum gradient of reducing potential is in the upper part of the furnace, where the highest iron oxides dominate ($Fe_2O_3$, $Fe_3O_4$).

Conventional gas-intake systems, arranged in the upper zone of the furnace, increase this negative effect due to their localized action, prevalently in the zone of the intake conduit.

A uniform distribution of the gas in the different transverse sections of the furnace, at different heights, depends on the hydraulic resistance of the layer of material loaded, the method used to inject the reducing gas and the upper intake of the gas.

Irregularities in the reduction process in the whole volume of the furnace lead to a worsening in the quality of the final product of the directly reduced iron (DRI) and to a reduction in production.

In conventional devices, the upper intake of the gas tends to occur preferentially through peripheral areas of the working space of the furnace, which excludes a stable process of the reducing gas in the central zone of the furnace.

The problems described above limit the diameters of conventional furnaces and consequently their productivity.

SUMMARY OF THE INVENTION

The furnace to produce metal iron by the direct reduction of iron oxides according to the invention is set forth and characterized in the main claim, while the dependent claims describe other innovative characteristics of the invention.

The furnace according to the invention is of the gravitational or shaft type, wherein both the material and the gas are fed continuously, so as to create a vertical and gravitational flow of the material and so that the direct reduction of the mineral occurs.

The reduction furnace is equipped with means to feed the mineral iron and means to discharge the reduced metal iron, and is equipped with at least an inlet collector, arranged laterally, to inject the reducing gas in correspondence with one or more reduction zones inside the furnace.

One purpose of the invention is to achieve a reduction furnace in which here is a uniform flow of reducing gas over the whole section of the shaft through the material.

One effect of this type in the upper part of the shaft leads to a uniform pre-heating of the material and a uniform production.

This invention also has the purpose of retaining the solid particles which are removed from the gas to be later distributed in the outer part of the section of the shaft.

In this way the removal of the fumes is reduced, and they are distributed in an optimum manner with the rest of the material.

In accordance with this purpose, the reduction furnace according to the invention comprises a gas intake device, with a toroidal grid of the cyclone type arranged in proximity with the upper roof of the furnace and associated with the intake conduit.

According to another characteristic feature of the invention, there is a system to partly channel the gas through the central zone of the grid. This system is equipped with a device to regulate the intake flow between the toroidal grid and the central zone of the grid.

In accordance with another characteristic feature, the grid of the upper chamber has a viable pitch from a minimum value, in correspondence with the intersection between the chamber and the intake conduit, and a maximum value, in a diametrically opposite zone of the chamber.

Other characteristic features of the invention are as follows: the toroidal grid is made with spirals wound on a vertical plane; the toroidal grid is provided with radially arranged legs; the lower part of the system to partly channel the gases is arranged lower than the toroidal grid.

BRIEF DESCRIPTION OF THE DRAWINGS

These and other characteristics of the invention will become clear from the following description of two preferred forms of embodiment, given as a non-restrictive example, with reference to the attached drawings wherein.

DETAILED DESCRIPTION OF TWO PREFERRED EMBODIMENTS

Figure 1:
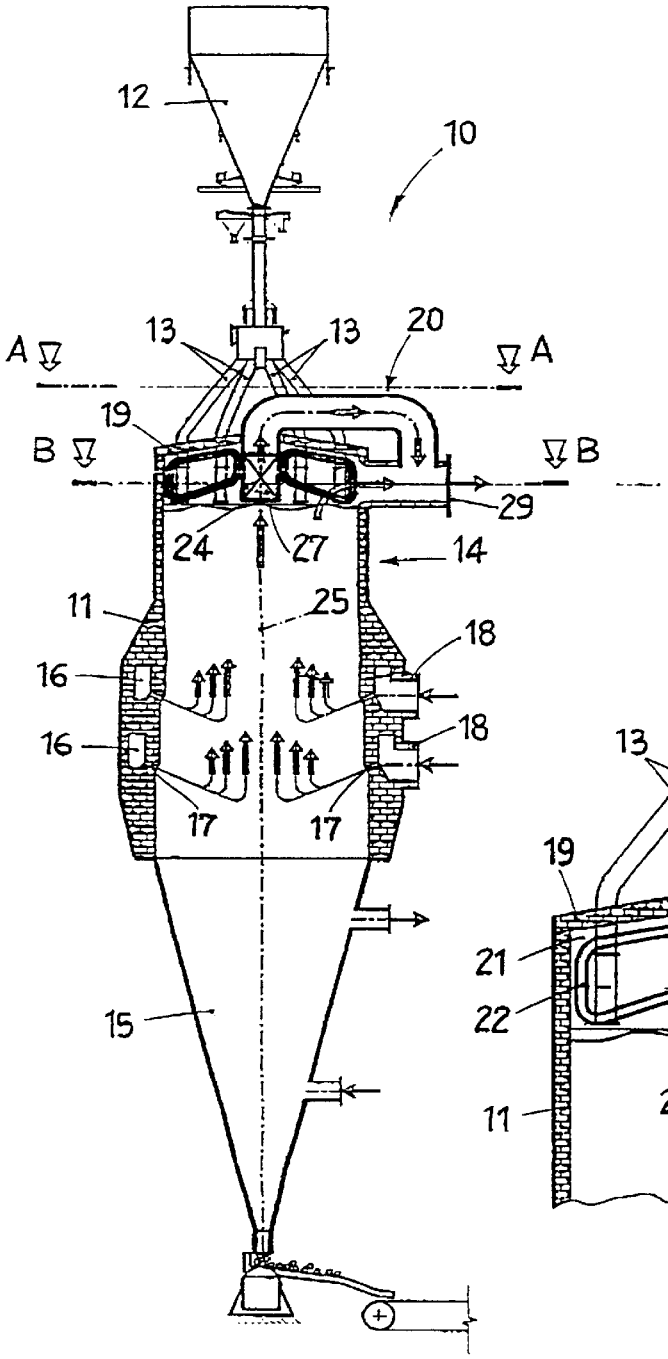
FIG. 1 is a sectioned side view of a furnace for the direct reduction of iron oxides according to the invention in a first form of embodiment.
Figure 2:
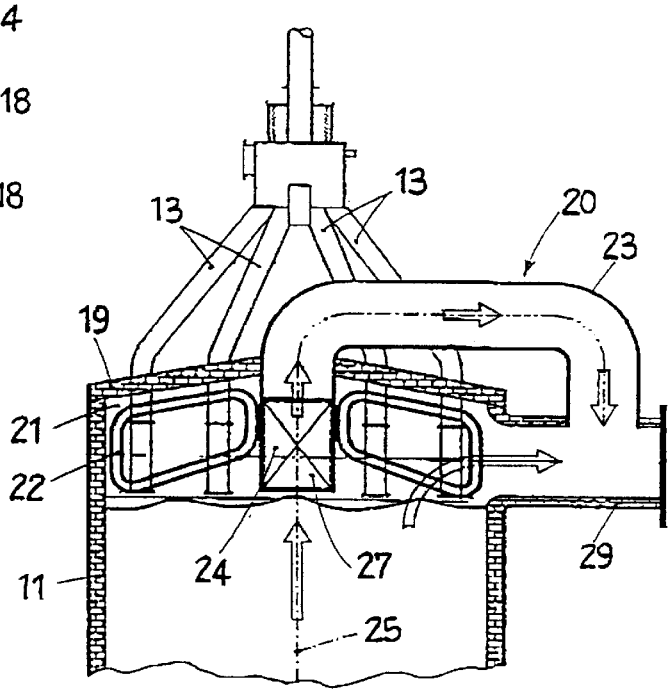
FIG. 2 is an enlarged detail of FIG. 1.
Figure 3:
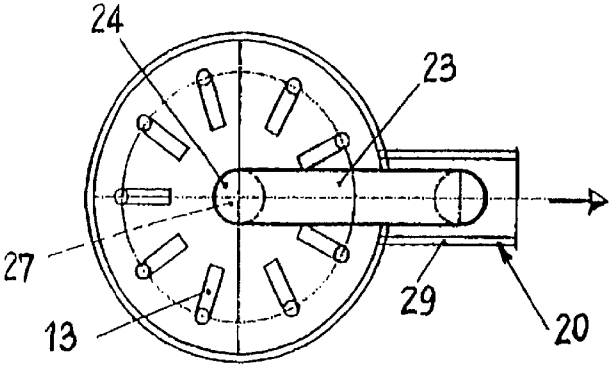
FIG. 3 is a section along the line A—A of FIG. 1.
Figure 4:
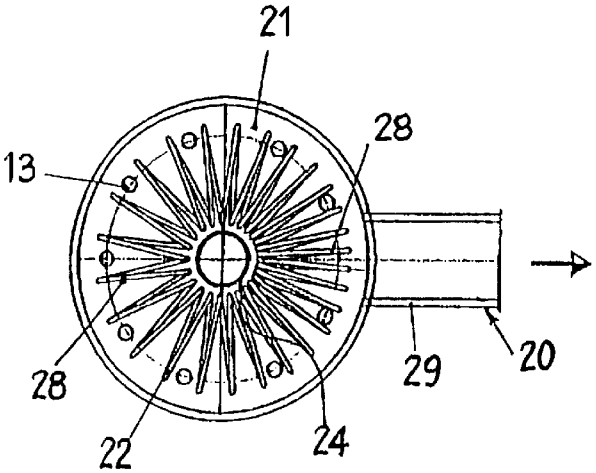
FIG. 4 is a section along the line B—B of FIG. 1.

With reference to FIGS. 1–4, a furnace 10 for the direct reduction of iron oxides according to the invention comprises a container 11, substantially cylindrical in shape, an upper loading container 12 from which, through distribution tubes 13, the mineral (iron oxides) is suitable to be introduced, a median reaction zone, or reactor 14, wherein the reduction reaction of the iron oxides takes place, and a lower zone or discharge zone 15, shaped like a truncated cone with the taper converging downwards.

In correspondence with the reactor 14, the furnace 10 comprises a pair of circumferential conduits 16, provided with nozzles 17, through which a mixture of reducing gas, arriving from corresponding conduits 18, is suitable to be introduced.

The reducing gas and the plant upstream of the conduits 18 can be of any known type, for example of the type described in the patent application n°. UD98A000212, filed by the Applicant on Nov. 12, 1998.

According to one characteristic of the invention, in the upper part of the furnace 10, in Proximity with the roof 19, an intake device 20 is provided, comprising a chamber 21 with a toroidal grid 22 and a conduit 23 having an inner terminal part 24 which is elbow-shaped and arranged in the center of the chamber 21, coaxially to the longitudinal axis 25 of the container 11.

An apparatus 27 to regulate the flow of gas taken in is arranged in the terminal part 24 of the conduit 23.

The toroidal grid 22 (FIG. 4) is made with radial elements 28 separated from each other with a variable pitch, so that the pitch has a minimum value in correspondence with the intersection between the chamber 21 and an outlet conduit 29, and a maximum value in a zone diametrically opposite the chamber 21.

Moreover, to increase the mechanical characteristics of the chamber 21, it is shaped as a spiral wound on a plane substantially orthogonal to the longitudinal axis 25.

The furnace 10 as described heretofore functions as follows:

The mineral iron, for example in pellet form, is introduced into the furnace 10 from the upper container 12 through the distribution tubes 13, while the reducing gas is introduced from the conduits 18 and distributed in the reactor 14 by the circumferential conduits 16, through the nozzles 17.

Due to the relatively low pressure with which the reducing gas is injected into the reactor 14, the flow of the reducing agent in the mass of mineral inside the furnace 10 would have a prevalently peripheral character, if the intake device 20 did not intervene.

In fact, by creating a suction effect in the conduit 23, with any known means which are not shown in the drawings, a depression is created above the mass of material which is in the reactor 14 and the propagation of the reducing gas is increased, from the periphery of the reactor 14 towards the central zone, in correspondence with the longitudinal axis 25.

The particular shape of the toroidal grid 22, with the elements 28 arranged around the central terminal part 24 of the intake conduit 23 with a variable pitch, ensures that the intake device 20 acts uniformly.

The apparatus 27, arranged in a central position, also increases the efficiency of the upward intake of the reducing gas, in the zone around the longitudinal axis 25, and consequently also the interaction between the mass of mineral and the reducing gas in that zone.

Particular efficacy is obtained by arranging the apparatus 27 at the mouth of the terminal part 24, at a lower level than the toroidal grid 22.

Figure 7:
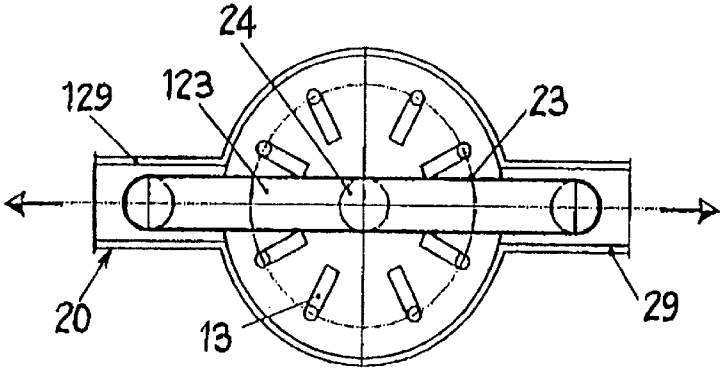
FIG. 7 is a section along the line C—C of FIG. 5.
Figure 8:
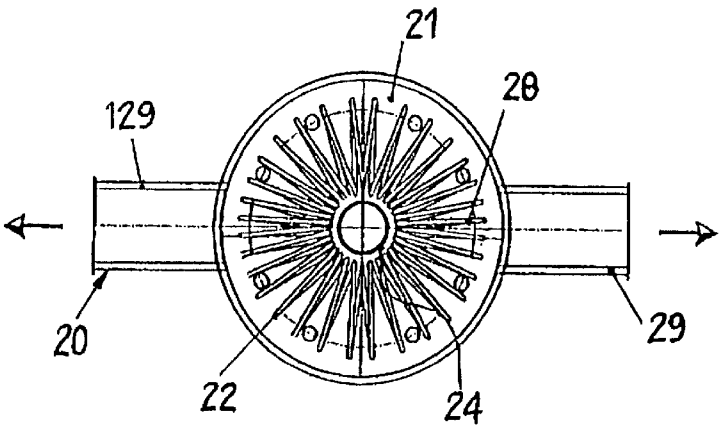
FIG. 8 is a section along the line D—D of FIG. 5.
Figure 5:
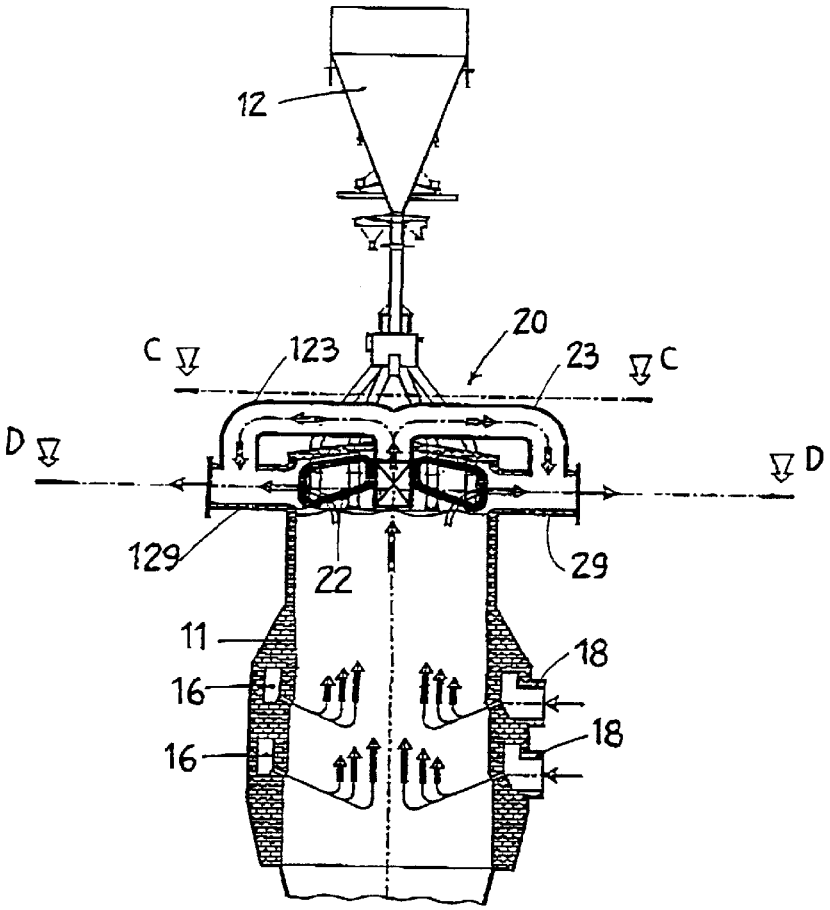
FIG. 5 is a sectioned side view of a variant of the furnace shown in FIG. 1.
Figure 6:
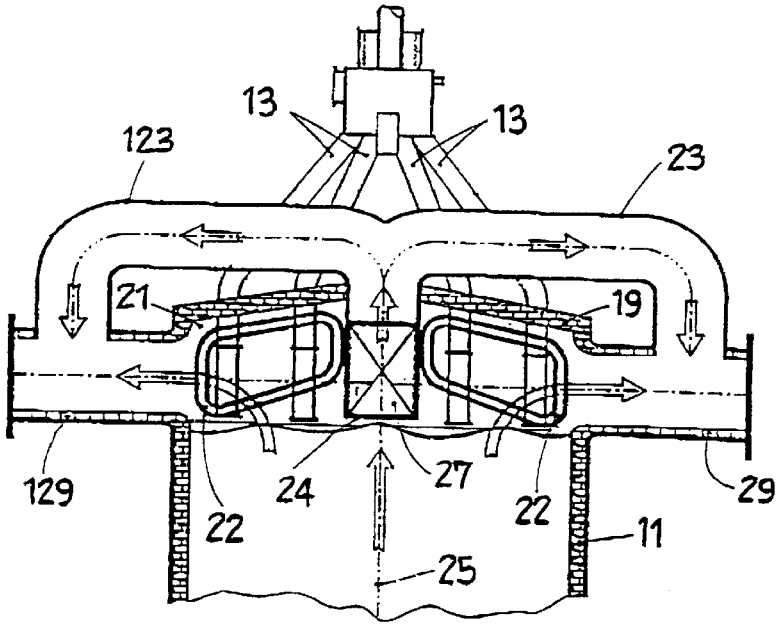
FIG. 6 is an enlarged detail of FIG. 5.

According to a variant, shown in FIGS. 5–8, the intake device 20 also comprises at least a second outlet conduit 129, diametrically opposite the First 29, and a second conduit 123 which puts the latter in communication with the central part 24.

It is therefore obvious that the furnace 10 according to the invention gives the following advantages:

the mineral introduced into the furnace 10 is treated with maximum efficiency by the reducing gas, without needing to excessively increase the quantity of reducing gas injected;

the toroidal grid 22 also acts as a filter or cleaner element for the particles and impurities which tend to rise from the mass of mineral in the reactor 14 towards the roof 19 of the furnace 10;

consequently, both the productivity of the furnace 10 and the clarity of the material produced are improved.

It is obvious that modifications and additions can be made to the furnace 10 for the direct reduction of mineral iron as described heretofore, but these shall remain within the field and scope of the invention.

It is also obvious that, although this invention has been described with reference to specific examples, a person of skill in this field will certainly be able to achieve many other forms of equivalent furnaces, but these shall all come within the field and scope of this invention.

What is claimed is:

1. A gravitational furnace for the direct reduction of mineral iron comprising:

a median reaction zone for conducting reactions to reduce the mineral iron, means to feed the mineral iron to said reaction zone, distribution means to introduce reducing gas into said reaction zone, discharge means to discharge the reduced metal iron, and an intake device for the reducing gas, said intake device comprising a chamber and a toroidal grid, wherein said intake device is positioned to have said chamber situated above said reaction zone, and said toroidal grid is arranged in said chamber.

2. A gravitation furnace as in claim 1, wherein said intake device comprises an intake conduit having a central and vertical terminal part arranged coaxial with a longitudinal axis, said toroidal grid being arranged coaxial with said terminal part.

3. A gravitational furnace as in claim 1, wherein an apparatus to regulate the intake flow of the gas is installed centrally to and coaxial with said chamber.

4. A gravitational furnace as in claim 2, wherein an apparatus to regulate the intake flow of the gas is arranged inside said terminal part.

5. A gravitational furnace as in claim 3, wherein a lower mouth of said apparatus is arranged at a lower level than said toroidal grid.

6. A gravitational furnace as in claim 2, wherein said intake device comprises at least a first outlet conduit arranged radially in correspondence with said chamber.

7. A gravitational furnace as in claim 6, wherein said intake device comprises at least a second outlet conduit diametrically opposite said first outlet conduit.

8. A gravitational furnace as in claim 2, wherein said toroidal grid comprises radial elements separated from each other with a pitch variable from a minimum value, in correspondence with the intersection between said chamber and said intake conduit, and a maximum value, in a diametrically opposite zone of said chamber.

9. A gravitational furnace as in claim 1, wherein said toroidal grid is wound in a spiral, with the coils arranged on a single plane substantially orthogonal to the longitudinal axis of the furnace.

10. A gravitational furnace as in claim 1, wherein said intake device comprises an intake conduit having a central and vertical terminal part.

11. A gravitational furnace as in claim 10, wherein said toroidal grid comprises radial elements separated from each other with a pitch variable from a minimum value, in correspondence with the intersection between said chamber and said intake conduit, and a maximum value, in a diametrically opposite zone of said chamber.

* * * * *